US008737868B2

(12) United States Patent
Tanabe et al.

(10) Patent No.: US 8,737,868 B2
(45) Date of Patent: May 27, 2014

(54) IMAGE FORMING APPARATUS

(75) Inventors: Yuichi Tanabe, Toride (JP); Takahiro Kobayashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 273 days.

(21) Appl. No.: 13/149,078

(22) Filed: May 31, 2011

(65) Prior Publication Data

US 2011/0293326 A1 Dec. 1, 2011

(30) Foreign Application Priority Data

May 31, 2010 (JP) ..... 2010-124705

(51) Int. Cl.
*G03G 21/00* (2006.01)

(52) U.S. Cl.
USPC ..... 399/107; 399/110; 399/114; 399/411

(58) Field of Classification Search
USPC ..... 399/114, 124, 380, 411
See application file for complete search history.

(56) References Cited

U.S. PATENT DOCUMENTS 6,374,067 B1 * 4/2002 Park ..... 399/107
7,424,249 B2 9/2008 Koshida
7,460,814 B2 * 12/2008 Ito ..... 399/124
7,551,873 B2 * 6/2009 Hiura ..... 399/107
7,643,772 B2 * 1/2010 Koshida ..... 399/110
2006/0104665 A1 5/2006 Koshida
2008/0138111 A1 * 6/2008 Ju et al. ..... 399/121
2008/0199211 A1 8/2008 Koshida
2010/0278557 A1 * 11/2010 Somemiya et al. ..... 399/124
2010/0329737 A1 * 12/2010 Koga et al. ..... 399/124
2010/0329738 A1 * 12/2010 Shirai ..... 399/124

FOREIGN PATENT DOCUMENTS

JP 2006-139052 A 6/2006

* cited by examiner

*Primary Examiner* — David Gray
*Assistant Examiner* — Francis Gray
(74) *Attorney, Agent, or Firm* — Fitzpatrick, Cella, Harper & Scinto

(57) ABSTRACT

An image forming apparatus includes a main assembly; a door member which supports one of roller members constituting a feeding nip for a recording material and which is rotatable about an axis parallel with said roller members in a sidewise direction of said main assembly to open said feeding nip; a pair of urging mechanisms which are provided at opposite end portions of said door member with respect to a front-rear direction of said main assembly and which fix said door member to said main assembly so as to be capable of opening and closing said door member, said urging mechanism urging said door member toward said main assembly in a state that said door member is closed; and an operating member provided with a grip for manual opening of said door member, said grip being disposed in a position nearer to a front side than a center portion position of said door member with respect to the front-rear direction, and said operating member being rotatably supported in a position nearer to a rear side than a center position between urging mechanisms.

7 Claims, 11 Drawing Sheets

(a)

(b)

IMAGE FORMING APPARATUS

FIELD OF THE INVENTION AND RELATED ART

The present invention relates to an image forming apparatus whose side door can be opened to expose the recording medium conveyance nip of the image forming apparatus. More specifically, it relates to the structure of the handle with which the side door of the image forming apparatus is provided to improve the apparatus in terms of the operation for disengaging the toggle latches of the like of the side door located at the front and rear ends of the side door.

An image forming apparatus designed to form a toner image, transfer the toner image onto recording medium, and fix the toner image to the recording medium by applying heat and pressure to the toner image has been widely in use. Normally, an image forming apparatus of this type is provided with a side door for removing the jammed recording medium in the nip between a pair or pairs of recording medium conveyance rollers of the apparatus, and is structured so that the side door can be rotated out of the main assembly of the apparatus to expose the nip (Japanese Laid-open Patent Application 2006-139052).

Japanese Laid-open Patent Application 2006-139052 discloses an image forming apparatus provided with a side door having a pair of pressure applying mechanisms (toggle latches, for example) located at the front and rear ends of the side door to keep the side door closed. Thus, as the side door is closed, the side door is kept pulled inward of the main assembly of the image forming apparatus, by the pressure applying mechanisms themselves, generating thereby pressure in the recording medium conveyance nip between each pair of recording medium conveyance rollers. Therefore, as the side door is opened, the pair of recording medium conveyance rollers are separated from each other. In other words, the operation of this image forming apparatus is easy to understand, simple in structure, and also, it is significantly smaller in the number of mechanical components.

The image forming apparatus disclosed by Japanese Laid-open Patent Application 2006-139052 is a relatively small printer. Therefore, its side door can be opened even from the front side of the image forming apparatus. That is, the side door can be opened by pulling the door outward by grasping the mid portion of the door, in terms of the front-to-rear direction of the door. In the case of a large image forming apparatus, that is, an image forming apparatus capable of handling a sheet of recording medium of a size A3, it is greater in size in terms of the front-to-rear direction, and therefore, its side door is rather difficult to open from the front side of the apparatus.

In the case of an image forming apparatus which is relatively large in terms of the front-to-rear dimension, the distance from the front end of its side door to the mid portion of the side door is also relatively large. Therefore, as a user grasps the handle of the side door, which is at the middle of the door in terms of the front-to-rear direction, while standing in front of the image forming apparatus, the arm of the user becomes stretched, making it difficult for the user to pull the side door outward.

As a means for dealing with the above-described problem, it was proposed to place the side door handle closer to the front end of the side door. However, as a test version of this side door was tested, this proposal also turned out to be problematic. That is, the pair of pressure applying mechanism which are at the front and rear ends of the side door, one for one, failed to synchronize in the timing with which they disengaged from the main assembly of an image forming apparatus. Consequently, it made the tester feel nervous or even uncomfortable as the tester opened the side door.

SUMMARY OF THE INVENTION

Thus, the primary object of the present invention is to ensure that a pair of pressure applying mechanisms with which the side door of an image forming apparatus is provided always and virtually simultaneously disengage from the main assembly of the apparatus, even if the side door is relatively large, in order to make it possible to provide an image forming apparatus, the side door of which feels more solid and easier to open to a user when the user opens the side door, than the side door of any of conventional image forming apparatus.

According to an aspect of the present invention, there is provided an image forming apparatus comprising a main assembly; a door member which supports one of roller members constituting a feeding nip for a recording material and which is rotatable about an axis parallel with said roller members in a sidewise direction of said main assembly to open said feeding nip; a pair of urging mechanisms which are provided at opposite end portions of said door member with respect to a front-rear direction of said main assembly and which fix said door member to said main assembly so as to be capable of opening and closing said door member, said urging mechanism urging said door member toward said main assembly in a state that said door member is closed; and an operating member provided with a grip for manual opening of said door member, said grip being disposed in a position nearer to a front side than a center portion position of said door member with respect to the front-rear direction, and said operating member being rotatably supported in a position nearer to a rear side than a center position between urging mechanisms.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Figure 1:
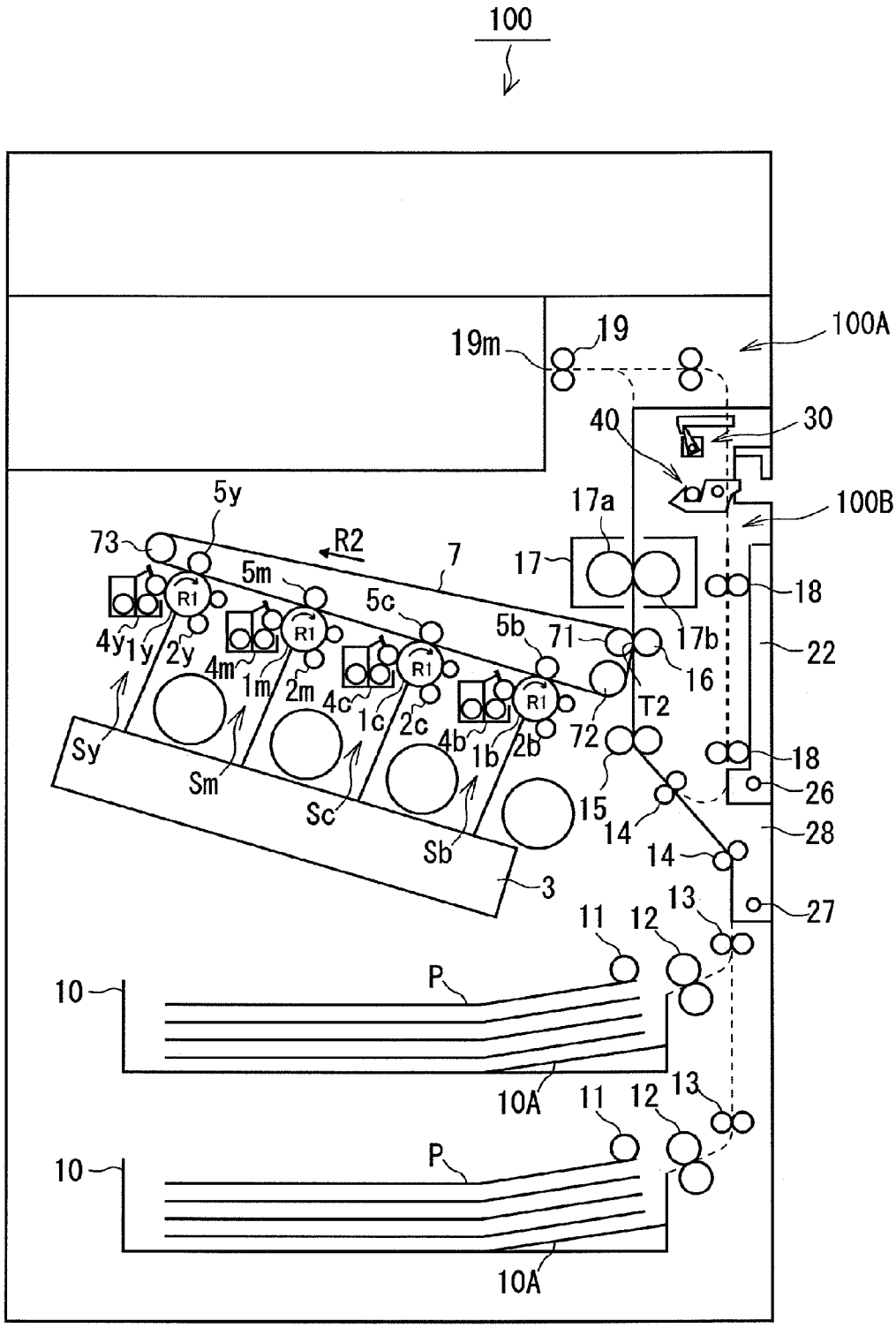
FIG. 1 is a schematic sectional view of the image forming apparatus in the first preferred embodiment of the present invention, and shows the structure of the apparatus.

Hereinafter, one of the preferred embodiments of the present invention is described in detail with reference to the appended drawings. The present invention can be embodied in the form an image forming apparatus other than the image forming apparatus which is described hereafter, even if the image forming apparatus to which the present invention is to be applied is partially or entirely different in structure from the image forming apparatus in the following embodiment of the present invention, provided that the image forming apparatus to which the present invention is to be applied is structured so that the side door of the apparatus can be rotationally opened, and also, so that the grip portion of the hand lever of the side door is positioned substantially frontward from the center of the side door.

That is, the side door of the image forming apparatus in this embodiment is provided with a pair of pressure applying means, and one of the pair of pressure applying means is at one end of the side door of the image forming apparatus, in terms of the front-to-rear direction, whereas the other is at the other end of the side door. However, the preferred embodiment is not intended to limit the present invention in scope. That is, each end of the side door may be provided with two or more pressure applying means, or one end of the side door may be provided with one pressure applying means, whereas the other end is provided with a pair of pressure applying means. In other words, the present invention is applicable to any image forming apparatuses regardless of developer type, image formation method (system). That is, the present invention is applicable to any image forming apparatus regardless of whether the apparatus is of the tandem type or single drum type, and/or of the intermediary transfer type or direct transfer type, as long as the apparatus is structured so that one of the pair of recording medium conveyance rollers which form the recording medium conveyance nip, can be moved away from the other recording medium conveyance roller to expose the nip portion of the recording medium conveyance passage.

Hereafter, this embodiment is described with reference to only the portions of an image forming apparatus, which are essential to the formation of a toner image. However, the present invention is also applicable to image forming apparatuses other than the one in this embodiment. That is, the present invention is applicable to a printer, a copying machine, a facsimile machine, a multifunction image forming apparatus, etc., which are examples of a combination of an image forming apparatus such as the image forming apparatus, and additional device or devices, equipment, and external structure (shell). The measurements and materials of the structural components of the image forming apparatus, their positional relationship, etc., in this embodiment of the present invention are not intended to limit the present invention in scope, unless specifically noted.

The features of the image forming apparatus in this embodiment, which are similar to the general features of the image forming apparatus disclosed in Japanese Laid-open Patent Application 2006-139052 are neither illustrated nor described.

<Image Forming Apparatus>

FIG. 1 is a schematic sectional view of an image forming apparatus 100, to which the present invention is applicable. It describes the structure of the apparatus. As shown in FIG. 1, the image forming apparatus 100 is a full-color printer of the so-called tandem type, and also, is of the so-called intermediary transfer type. That is, the apparatus 100 has an intermediary transfer belt 7, and yellow, magenta, cyan, and black image forming stations Sy, Sm, Sc, and Sb which are sequentially arranged in the listed order along the intermediary transfer belt 7.

In the image forming portion Sy, a yellow toner image is formed on a photosensitive drum 1*y*, and is transferred onto the intermediary transfer belt 7. In the image forming portion Sm, a magenta toner image is formed on a photosensitive drum 1*m*, and is transferred onto the intermediary transfer belt 7. In the image forming portions Sc and Sb, a cyan toner image and a black toner image are formed on a photosensitive drum 1*c* and a photosensitive drum 1*b*, respectively, and are transferred onto the intermediary transfer belt 7.

The intermediary transfer belt 7 is suspended, and remains stretched, by a driver roller 72, a backup roller 71, and a tension roller 73. It is rotated by the driver roller 72 in the direction indicated by an arrow mark R2. After the transfer of the four monochromatic toner images, different in color, onto the intermediary transfer belt 7, the toner images are conveyed to the second transfer station T2, and are transferred (second transfer) onto a sheet P of recording medium.

A recording medium cassette 10 contains a substantial number of sheets P of recording medium. As the sheets P are moved out of the cassette 10, each sheet P is separated from the rest, and is conveyed to a pair of registration rollers 15, which release the sheet P with such timing that the sheet P arrives at the second transfer station T2 at the same time as the toner images on the intermediary transfer belt 7.

When the image forming apparatus 100 is in the mode for forming an image on only one surface of the sheet P of recording medium, the sheet P is conveyed to a fixing device 17 after the formation of an image on one of the two surfaces of the sheet P. In the fixing device 17, the toner images on the sheet P are fixed to the surface of the sheet P by the heat and pressure applied to the toner images by the fixing device 17. Then, the sheet P is discharged from the image forming apparatus 100 through a sheet outlet 19*m* by a pair of discharge rollers 19. On the other hand, when the image forming apparatus 100 is in the mode for forming an image on both surfaces of the sheet P, the sheet P is moved back into the image forming apparatus 100 by the pair of discharge rollers 19 after being discharged halfway from the apparatus. Then, the sheet P is conveyed to pairs of recording medium conveyance rollers 18, which are on the outward side of the apparatus relative to the fixing device 17.

Then, the sheet P of recording medium is conveyed for the second time to the pair of registration rollers 15 by the pairs of recording medium conveyance rollers 18. Then, toner images are transferred onto the back side of the sheet P from the intermediary transfer belt 7. Then, the toner images on the back surface of the sheet P are fixed to the back surface of the sheet P by the fixing device 17. Then, the sheet P is discharged from the apparatus 100 by the discharge rollers 19. The fixing apparatus 17 comprises: a fixation roller 17*a* having an internal heater; and a pressure roller 17*b*. It fixes the unfixed toner images on the sheet P to the sheet P by applying heat and pressure to the sheet P and unfixed toner images thereon as the sheet P is conveyed through the fixing apparatus 17.

The image forming stations Sy, Sm, Sc, and Sb are roughly the same in structure although they are different in the color of the toner which their developing devices 4y, 4m, 4c, and 4b, respectively, use. Thus, in the following description of this embodiment of the present invention, only the image forming station Sy is described, since the description of the image forming stations Sm, Sc, and Sb are the same as that of the image forming station Sy except for the suffixes m, c, and b of their referential codes.

The image forming station Sy has: a photosensitive drum 1y; and a charge roller 2y, an exposing device 3, a developing device 4y, and a first transfer roller 5y, which are in the adjacencies of the peripheral surface of the photosensitive drum 1y. The photosensitive drum 1y comprises: a cylindrical substrate; and a photosensitive layer which covers virtually the entirety of the peripheral surface of the photosensitive drum 1y and is negative in intrinsic polarity. It is rotated in the direction indicated by the arrow mark R1 at a preset process speed. The charge roller 2y uniformly charges the peripheral surface of the photosensitive drum 1 to the negative polarity. The exposing device 3 writes an electrostatic latent image on the uniformly charged portion of the peripheral surface of the photosensitive drum 1y, by scanning the uniformly charged portion with a beam of laser light with the use of its rotational polygonal mirror.

The developing device 4y forms a visible image, that is, an image formed of toner (which hereafter will be referred to simply as toner image) by developing the electrostatic latent image on the peripheral surface of the photosensitive drum 1y, with the use of developer. The first transfer roller 5y transfers (first transfer) the toner image on the photosensitive drum 1y, onto the intermediary transfer belt 7 by being supplied with a positive DC voltage.

The recording medium cassette 10 stores in layers a substantial number of sheets P of recording medium of a preset size. It comprises a feed roller 11 and an internal plate 10A. The feed roller 11 takes the sheets P out of the cassette 10. The internal plate 10A is rotatably held to the cassette 10 by its upstream end, and is kept pressured toward the feed roller 11 by unshown coil springs. The image forming apparatus 100 has also a pair of separation rollers 12, which are on the downstream side of the feed roller 11 in terms of the direction in which the sheet P is conveyed by the feed roller 11. As the sheets P are taken out of the recording medium cassette 10 by the feed roller 11, they are sent to the compression nip of the pair of separation rollers 12. As the sheets P are fed into the compression nip, one of the sheets P is separated from the rest by the difference between the top and bottom separation rollers 12 in terms of their friction relative to the sheet P. Then, the separated sheet P is conveyed to the pair of registration rollers 15 by two pairs of recording medium conveyance rollers 13 and two pairs of recording medium conveyance rollers 14.

<Door Unit>

Figure 2:
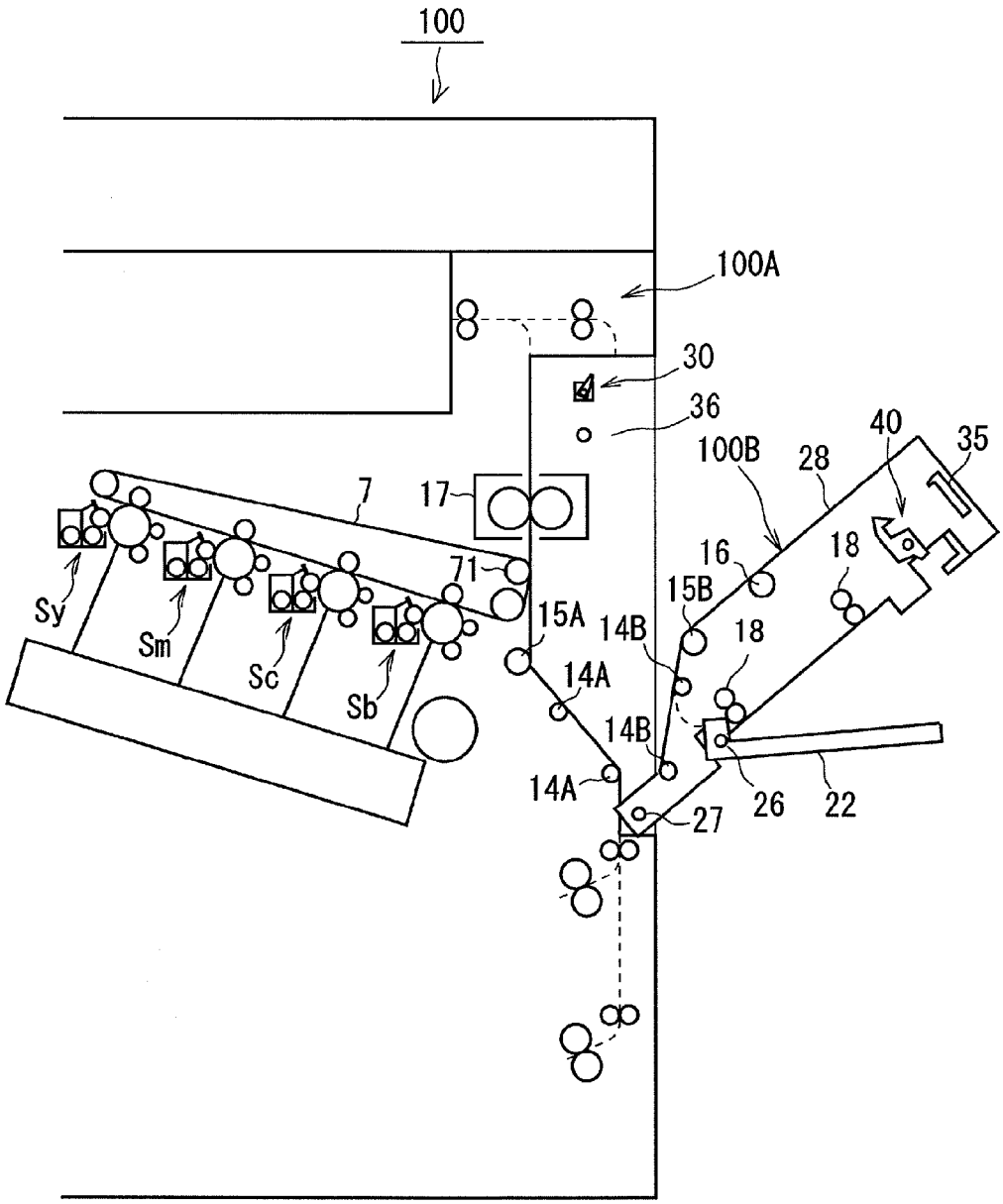
FIG. 2 is a schematic drawing for describing the mechanical structure of the side door of the image forming apparatus in FIG. 1, which is for exposing the recording medium conveyance passage of the apparatus.
Figure 3:
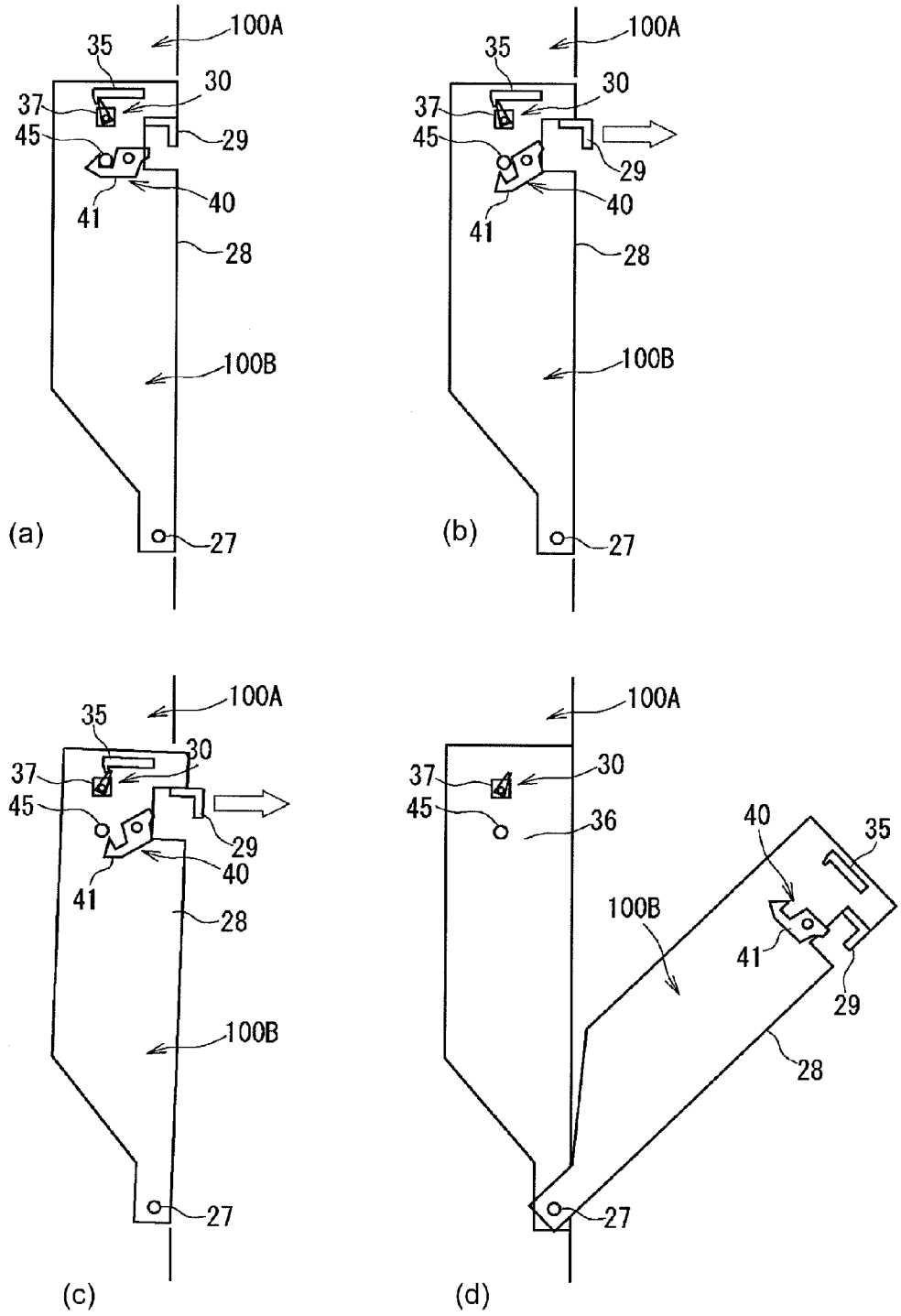
FIG. 3 is a drawing for showing the steps for exposing the recording medium conveyance passage of the image forming apparatus in FIG. 1.

FIG. 2 is a schematic side view of the side door, and its adjacencies, of the main assembly of the image forming apparatus 100. The side door is for allowing the recording medium conveyance passage of the apparatus main assembly to be exposed. FIG. 3 is a drawing for describing the operational steps for opening the side door to expose the recording medium conveyance passage.

In order to allow a user to take care of the recording medium jam, the image forming apparatus 100 is structured so that a part of its external shell can be opened. That is, the external shell is provided with a door unit 100B, which is opened or closed relative to the external shell of the apparatus main assembly. The door unit 100B makes up a part of the recording medium conveyance passage, and can be rotationally opened or closed relative to the external shell, about its bottom edge by which it is attached to the external shell. When it is necessary to take care of the recording medium jam, the door unit 100B can be opened to expose the recording medium conveyance passage, wide enough for the recording medium jam to be easily taken care of.

Referring to FIG. 2, the recording medium conveyance passage can be exposed by rotationally moving the door unit 100B out of the apparatus main assembly 100A about a door unit supporting shaft 27 in the clockwise direction. That is, the door unit 100B can be moved out of the apparatus main assembly 100A in such a manner that the door unit 100B rotationally moves out of the apparatus main assembly 100A. As the door unit 100B is rotationally moved out of the apparatus main assembly 100A, the recording medium conveyance passage is widely exposed, allowing thereby the jammed sheet P of recording medium to be easily taken out of the apparatus main assembly 100A. As described above, the apparatus main assembly 100A has the fixing apparatus 17, intermediary transfer belt 7, backup roller 71, recording medium conveyance roller 14A, and registration roller 15A, which are within the apparatus main assembly 100A.

The door unit 100B, which is an example of a side door, supports one of each of pairs of rollers which form the nips, one for one, through which the sheet P of recording medium is conveyed. The apparatus main assembly 100A and door unit 100B are structured so that the door unit 100B can be rotationally moved out (or back into) the apparatus main assembly 100A, about the door unit supporting shaft 27, which is parallel to the axial line of each of the recording medium conveyance rollers in order to move one of each of pairs of nip forming rollers away from the corresponding roller. The door unit 100B comprises: a one-piece frame 28 molded of resinous substance; a second transfer roller 16, a conveyance roller 14B, a registration roller 15B, etc., which are attached to the frame 28.

Next, referring to FIG. 3(*a*), the apparatus main assembly 100A is provided with a pair of toggle latch mechanisms 37, which are parts of the aforementioned pressure applying mechanism. The toggle latch mechanisms 37 are positioned so that they correspond to the ends of the door unit 100B in terms of the lengthwise direction of the recording medium conveyance rollers. They have a toggle arm 39 (lever) which can be switched in position to keep the door unit 100B closed relative to the external shell of the apparatus main assembly 100A, or to allow the door unit 100B to be rotationally moved out of the external shell. Further, the door unit 100B is provided with a pair of auxiliary locking mechanism 40. The auxiliary locking mechanism 40 can be set to prevent the door unit 100B from being opened.

If a sheet P of recording medium becomes jammed in the recording medium conveyance passage of the image forming apparatus 100 for some reason during an image forming operation, and therefore, the image forming apparatus 100 stops, the jammed sheet P of recording medium has to be removed. The procedure for removing the jammed sheet P of recording medium is as follows:

As a sheet P of recording medium becomes jammed in the recording medium conveyance passage of the image forming apparatus 100, a message "Remove jammed paper by opening side door" is shown on the display of the unshown control panel of the apparatus main assembly 100A. After the confirmation of the message, a user is to carry out the operation for opening the door unit 100B.

Next, referring to FIG. 3(*b*), the user is to pull the hand lever 29 of the door unit 100B in the outward direction of the apparatus main assembly 100A. The hand lever 29 is one of the members to be operated to open the door unit 100B. As the hand lever 29 is pulled, the auxiliary locking mechanism 40 is unlocked. When the door unit 100B is remaining closed, each toggle latch mechanism 37 solidly attached to the apparatus main assembly 100A remains engaged with a hook 35 solidly attached to door unit 100B, and therefore, the pressure applying mechanism (37) keeps the door unit 100B pressed upon the external shell of the apparatus main assembly 100A by the front and rear end portions of the door unit 100B.

Therefore, while the door unit 100B remains closed as shown in FIG. 1, a certain amount of pressure is present in the recording medium conveyance nip between each pair of the recording medium conveyance rollers.

Next, referring to FIG. 3(*c*), the user is to pull the hand lever 29, which is an example of the members to be operated to open the door unit 100B, further in the direction to open the door unit 100B, the toggle arm 39 of the toggle latch mechanism 37 is flipped by the hook 35 of the door unit 100B, allowing thereby the toggle latch mechanism 37 of the pressure applying mechanism to be disengaged from the hook 37. Consequently, the pressure in the nip of each of the aforementioned pairs of recording medium conveyance rollers vanishes. Then, the door unit 100B is to be opened, as far as it can be, by the pulling of the hand lever 29, as shown in FIG. 3(*d*), so that the recording medium conveyance passage is fully exposed to allow the jammed sheet P of recording medium to be removed.

Then, the user is to remove the jammed sheet P of recording medium from the exposed recording medium conveyance passage. Then, the user is to close the door unit 100B to enable the image forming apparatus 100 to restart the interrupted image forming operation.

Figure 8:
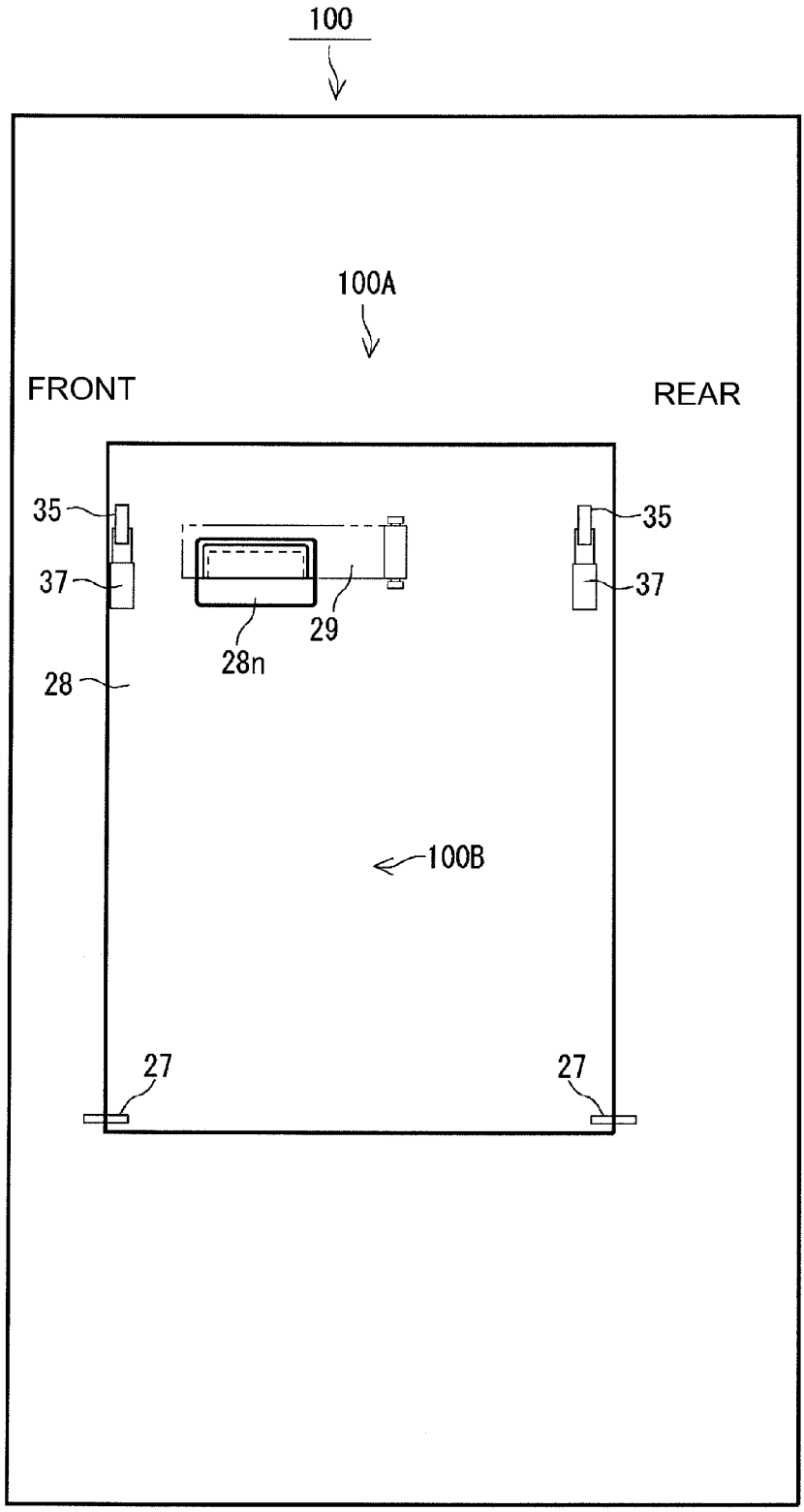
FIG. 8 is a side view of the image forming apparatus, and shows the positioning of the hand lever of the side door.

In the case of the image forming apparatus 100, the second transfer roller 16 for transferring toner images onto a sheet P of recording medium, and the recording medium conveyance passage for two-sided image formation mode, are on the door unit 100B as shown in FIG. 2. In other words, the door unit 100B of the image forming apparatus 100 is greater in the number of components attached thereto than the door unit (100B) of any of conventional image forming apparatuses. In other words, the door unit 100B is greater in size and/or weight than the door unit (100B) of any of conventional image forming apparatuses. Therefore, in order to compensate for the extra amount of the force, which has to be applied to the door unit 100B to close the door unit 100B, the apparatus main assembly 100A is provided with the aforementioned pair of toggle latch mechanisms 37, which are attached to the side plates of the apparatus main assembly 100A. As for the position of the toggle latch mechanisms 37, they correspond to the front and rear ends of the door unit 100B, one for one. The details of the door unit 100B are shown in FIG. 8.

Usually, when a user operates an image forming apparatus, the user stands in front of the apparatus. Thus, if the hand lever for opening the side door of the apparatus is closer to the rear end of the apparatus, it is difficult to operate. Therefore, in the case of the image forming apparatus 100, the hand lever 29 for opening or closing its door unit 100B is located near the front end of the apparatus main assembly 100A, in order to make it easier for the user to operate the hand lever 29 to open or close the door unit 100B.

<Toggle Latch Mechanism>

Figure 4:
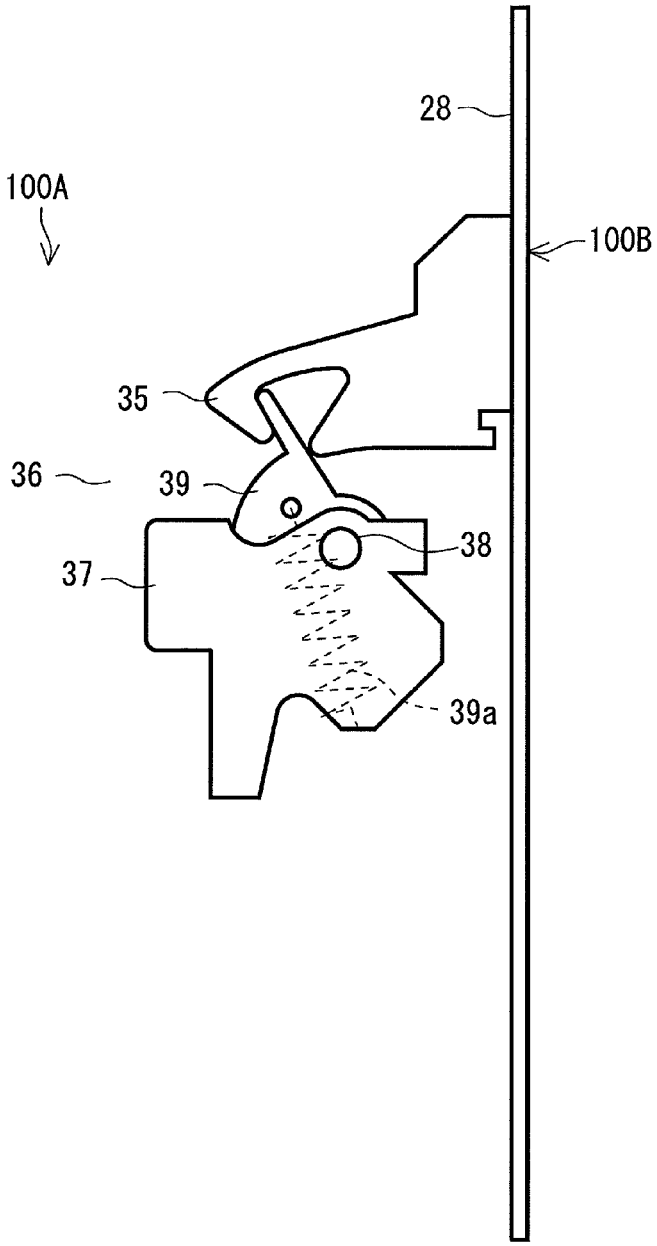
FIG. 4 is a side view of the toggle latch mechanism of the apparatus main assembly when the side door is closed.
Figure 5:
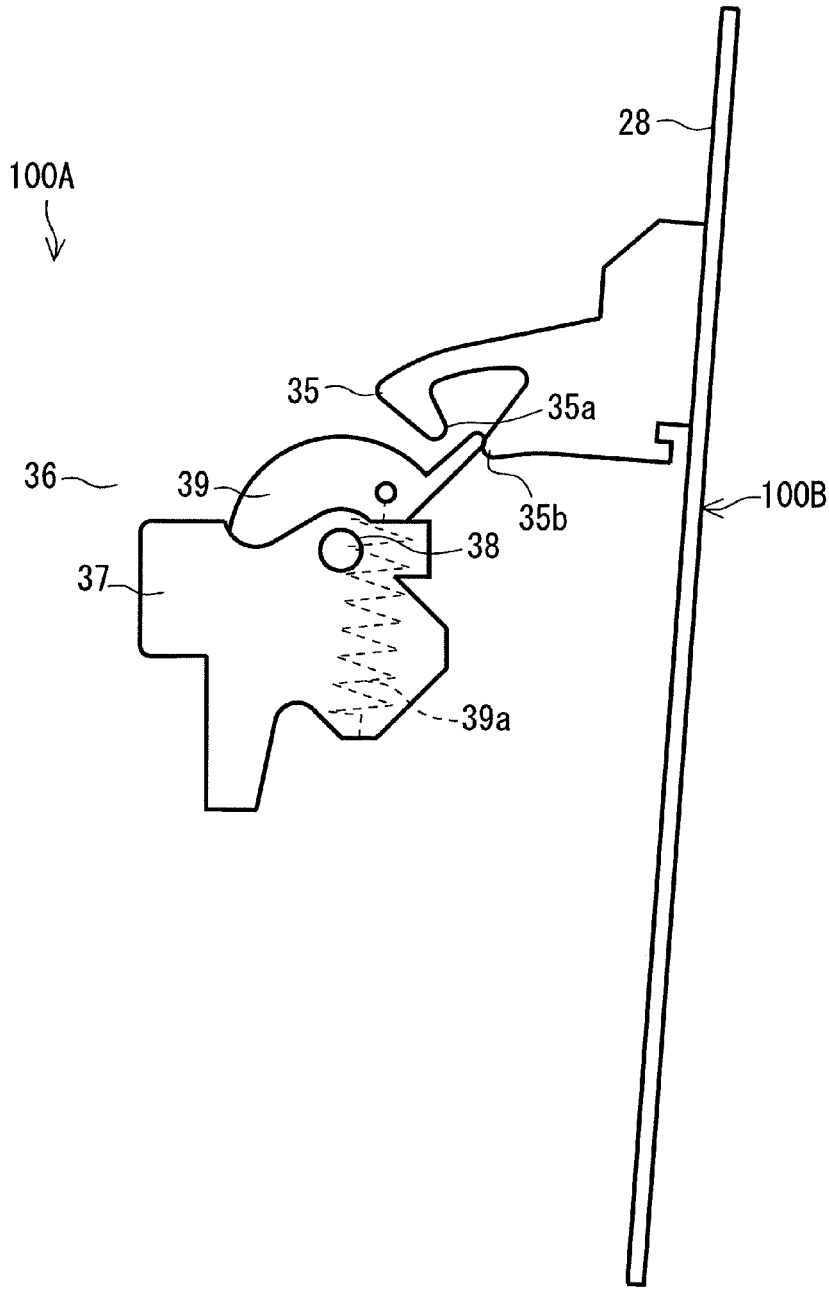
FIG. 5 is a side view of the toggle latch mechanism of the apparatus main assembly when the side door is open.

FIG. 4 is a drawing for describing the state of the toggle latch mechanism when the door unit 100B is remaining closed, whereas FIG. 5 is a drawing for describing the state of the toggle latch mechanism when the door unit 100B is open.

Referring to FIG. 4 along with FIG. 2, the door unit frame 28 is provided with the aforementioned pair of hooks 35, which engage with the corresponding toggle latch mechanisms 37. On the other hand, the side plate 36 of the apparatus main assembly 100A is provided with the aforementioned pair of toggle latch mechanisms 37, which are precisely position relative to the side plate 36 so that they catch the hooks 35 at preset positions to precisely hold the door unit 100B closed relative to the side plate 36. That is, the door unit 100B is held closed to the apparatus main assembly 100A by being pulled inward of the apparatus main assembly 100A by the toggle latch mechanisms 37 of the apparatus main assembly 100A.

As described above, the apparatus main assembly 100A is provided with the pair of toggle latch mechanisms 37, which correspond in position to the front and rear ends of the door unit 100B, one for one. The amount of force F1 which the front toggle latch mechanism 37 generates to hold the door unit 100B closed is the same as the amount of force F1 (FIG. 1) which the rear toggle latch mechanism 37 generate to hold the door 100*b* closed. Each toggle latch mechanism 37 comprises: a toggle latch supporting shaft 38 attached to the side plate 36; a toggle arm 39 rotationally supported by the shaft 38; and a tension spring 39*a* which keeps the hook 35 pulled toward the toggle lever mechanism 37.

Next, referring to FIG. 5 along with FIG. 2, as the user rotationally moves the door unit frame 28 outward by pulling the hand lever 29 outward, the hook 35 rotationally moves the toggle arm 39 outward against the resiliency of the tension spring 39*a*. As the door unit frame 28 is rotationally moved outward beyond the angle at which the tension springs 39*a* is largest in tension, the toggle arm 39 is sprung in the opposite direction from the direction in which it was kept pressed. Thus, the hook 35 is pushed outward by the toggle arm 39, being thereby disengaged from the toggle arm 39.

As for the procedure for moving the door unit 100B back into the apparatus main assembly 100A after the removal of the jammed sheet P of recording medium, first, the user is to rotationally move the door unit 100B toward the side plate 36. As the door unit 100B is rotationally moved toward the side plate 36, the toggle arm engaging portion 35*b* of the hook 35, which is lower in position than the toggle arm engaging portion 35*a* of the hook 35, pushes the toggle arm 39, rotationally moving thereby the toggle arm 39. As the angle by which the toggle arm 39 is rotated exceeds the angle at which the tension spring 39*a* is largest in tensional, the toggle arm 39 snappingly falls inward of the apparatus main assembly 100A, engaging thereby with the toggle arm engaging portion 35*a* of the hook 35. Thus, the hook 35 is pulled inward of the apparatus main assembly 100A by the resiliency of the tension spring 39*a*, creating thereby a nip with a proper amount of internal pressure, between the top and bottom rollers of each of the pairs of recording medium conveyance rollers.

Providing the apparatus main assembly 100A with the toggle latch mechanisms 37 can assist a user in terms of the amount of force required of the user to close the door unit 100B, and therefore, can improve the door unit 100B (image forming apparatus 100) in operability.

<Auxiliary Locking Mechanism>

Figure 6:
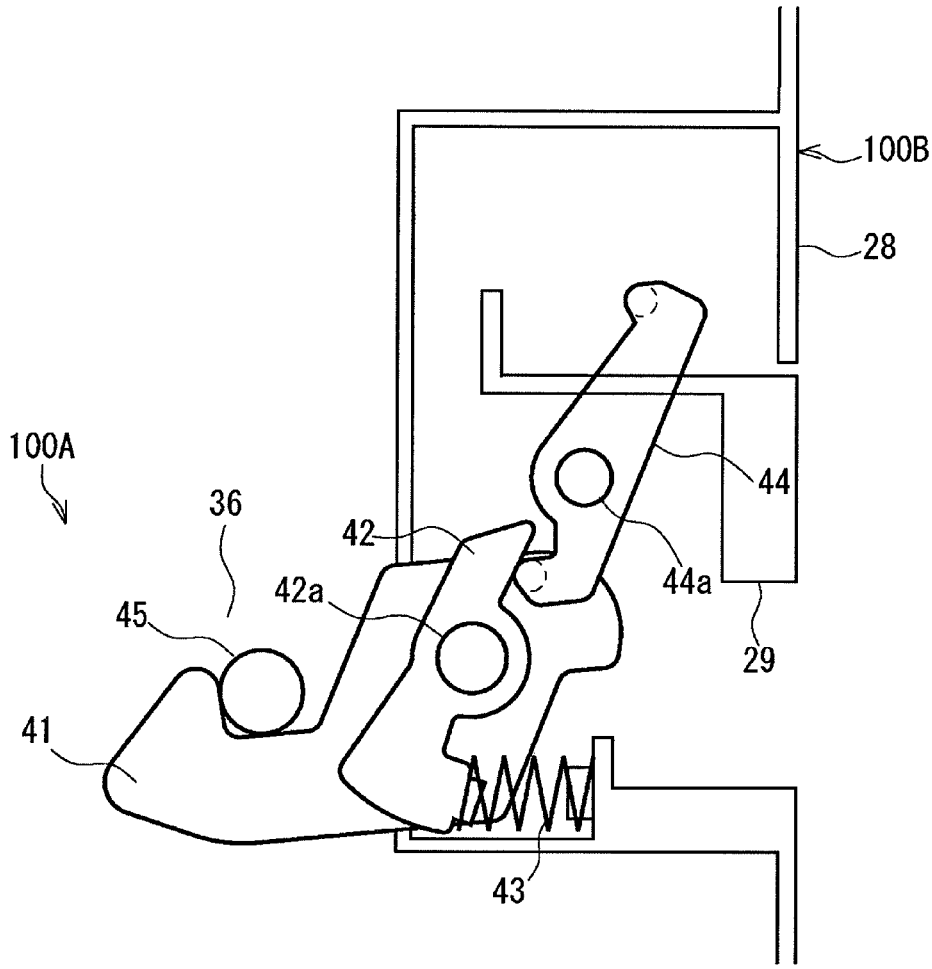
FIG. 6 is a side view of the auxiliary locking mechanism when the side door is closed.
Figure 7:
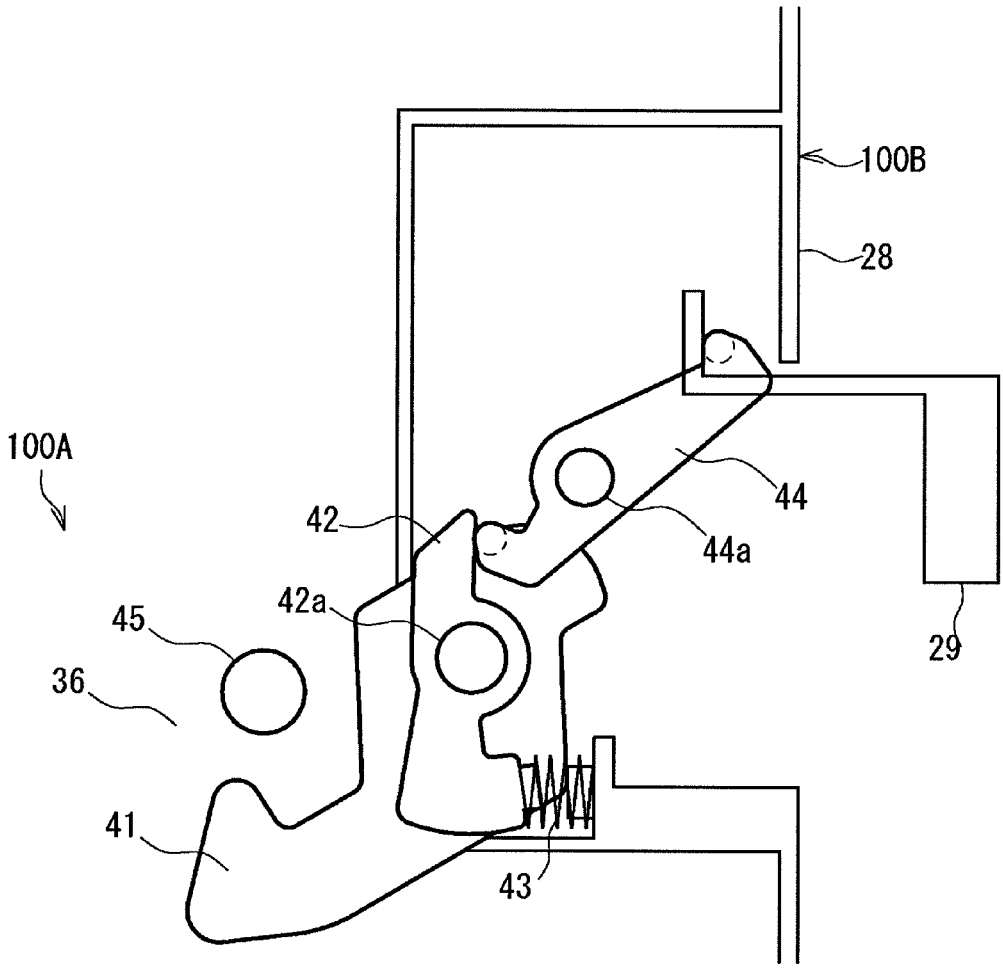
FIG. 7 is a side view of the auxiliary locking mechanism when the side door is open.

FIG. 6 is a side view of the auxiliary locking mechanism when the door unit 100B is kept closed. FIG. 7 is a side view of the door unit locking auxiliary mechanism when the door unit 100B is open.

Referring to FIG. 6 along with FIG. 2, the door unit frame 28 is provided with a pair of auxiliary locking mechanisms 40, each of which has a latch 41, a levers 42 (as part of mechanical linkage), a lever 44 (part of mechanical linkage), and a compression spring 43. The auxiliary latch 41 is for preventing the door unit 100B from opening. The lever 42 is for disengaging the auxiliary latch 41, and is in contact with the lever 44 (part of mechanical linkage). The door unit frame 28 rotationally supports a pair of auxiliary latch shafts 42*a*, to which the linkage lever 42 is solidly attached. Therefore, the auxiliary latch 41 and linkage lever 42 rotationally move with the auxiliary latch shaft 42*a*.

The auxiliary latch shaft 42*a* is kept in a preset position by being under an auxiliary latch spring 43 (compression spring) which is between one end of the linkage lever 42 and the door unit frame 28. The door unit frame 28 rotationally supports a handle linkage 44, which is positioned so that its upper end can be pressed by a part of the hand lever 29, and also, so that its bottom end is kept pressed by the top portion of the linkage lever 42.

Each of the front and rear plates 36 of the apparatus main assembly 100A is provided with a cylindrical projection 45 (auxiliary lock catch), which is precisely positioned so that it catches the corresponding auxiliary latch 41 at a preset position.

When the door unit 100B is remaining closed, it is kept pulled inward of the apparatus main assembly 100A by the toggle latch mechanisms 37 as shown in FIG. 4. As the door unit 100B is pulled into the apparatus main assembly 100A, the auxiliary latch 41 is guided by the cylindrical projection 45, and becomes locked with the cylindrical projection 45, as shown in FIG. 6. In other words, as the door unit 100B is closed, not only is it locked by the toggle latch mechanisms 37, but also, by the door unit locking auxiliary mechanisms. On the other hand, when the door unit 100B is opened, the auxiliary locking mechanisms 40 are disengaged by the rotational movement of the hand lever 29 before the toggle latch mechanisms 37 are disengaged by the rotational movement of the hand lever 29.

As the door unit frame 28 is subjected to force, it is likely to deform. Thus, if a user pulls the door unit frame 28 by the portion of the door unit frame 28, which is very close to the front end of the door unit frame 28 to open the door unit frame 28, the door unit frame 28 is deformed by the torsional force generated as the door unit frame 28 is pulled. Thus, the front toggle latch mechanism 37 is disengaged from the door unit frame 28 before the rear toggle latch mechanism 37 is disengaged. That is, the front end portion of the door unit frame 28 separates from the apparatus main assembly 100A while the rear end portion of the door unit frame 28 is still kept in contact with the apparatus main assembly 100A by the rear toggle latch mechanism 37. Therefore, the door unit frame 28 is deformed by the torsional force generated by the combination of the force generated by the rear toggle latch mechanism in the direction to pull the door unit frame 28, and the force applied to the front end portion of the door unit frame 28 to open the door unit 100B.

In order for a user to open the door unit 100B, the user has to pull the door unit 100B with a force which is greater than the force applied to the door unit 100B by the toggle latch mechanisms 37 in the direction to keep the door unit 100B pulled inward of the apparatus main assembly 100A. Therefore, if the frame 28 of the door unit 100B deforms because the door unit 100B is insufficient in rigidity, and/or because of the like reason, the door unit 100B (image forming apparatus 100) feels flimsy and uncomfortable to operate.

In particular, in the case where the hand lever 29, which is to be pulled by a user to open the door unit 100B, is positioned very close to the front side of the door unit 100B, the force to which the front side of the door unit 100B is subjected is significantly greater than the rear side of the door unit 100B. In other words, the amount of the force to which the front toggle latch mechanism 37 is subjected becomes different from the amount of the force to which the rear toggle latch mechanism 37 is subjected. Consequently, the front end portion of the door unit 100B separates from the apparatus main assembly 100A before the rear end portion of the door unit 100B separates from the apparatus main assembly 100A, making the door unit 100B (image forming apparatus 100) feel even more uncomfortable to the user.

One of the solutions for preventing the door unit 100B from feeling uncomfortable to operate is to insert reinforcing members such as metallic plates in the door unit frame 28 in order to minimize the door unit frame 28 in deformation. Such a solution, however, makes the door unit 100B heavier, and also, increases the door unit 100B in component count, increasing therefor the door unit 100B in cost.

In this embodiment, therefore, the door unit 100B is kept locked also by the aforementioned pair of auxiliary locking mechanisms 40 on the front and rear sides, respectively, of the door unit 100B so that it is only by operating (pulling) the hand lever 29 that the door unit 100B can be opened. Further, the hand lever 29 is mounted in a specific way so that the force applied to the hand lever 29 by a user is transmitted to both toggle latch mechanisms 37 neither excessively nor insufficiently to disengage the toggle latch mechanisms 37 so that both toggle lever mechanisms 37 can be repeatedly disengaged virtually simultaneously in a satisfactory manner. Because the image forming apparatus 100 and its door unit 100B are structured as described above, both toggle latch mechanisms 37 are disengaged at the same time, and therefore, the door unit 100B is unlikely to be torsionally deformed.

The hand lever 29 is provided with a latch 29*a* which is to be pulled by a user when the user wants to open the door unit 100B. The latch 29*a* is near the front end of the hand lever 29. The hand lever 29 is also provided with a mechanism, through which the hand lever 29 is in connection to an opposite portion of the door unit 100B from the portion to which the aforementioned portion 29*a* is attached, in terms of the direction parallel to the lengthwise direction of each of the recording medium conveyance rollers. The linkage between the hand lever 29 and door unit frame 28 is structured so that as the hand lever 29 of the door unit 100B is pulled by a user by the latch 29*a* in the direction to open the door unit 100B, the two toggle latch mechanisms 37 virtually simultaneously disengage.

Embodiment 1

Figure 9:
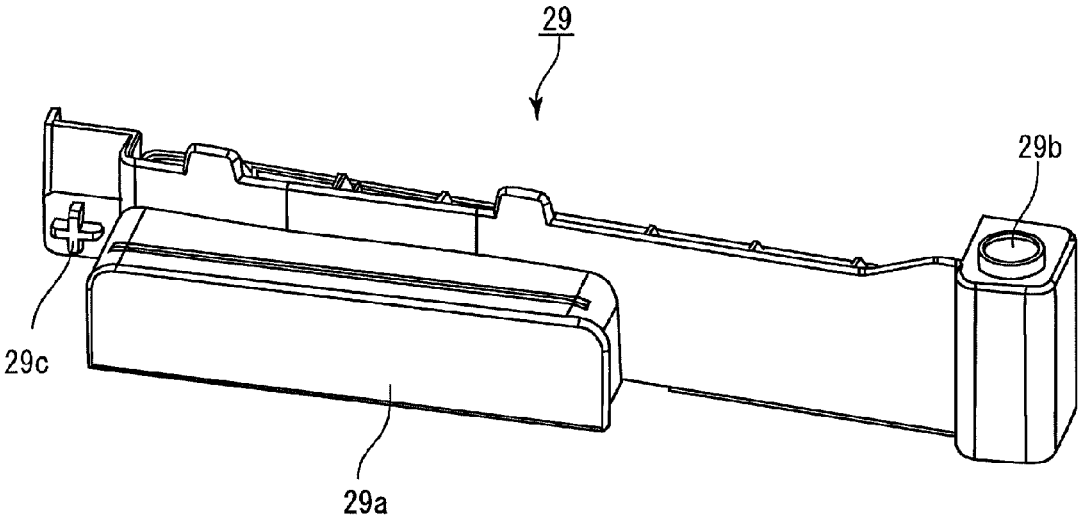
FIG. 9 is a perspective view of the hand lever of the side door.
Figure 10:
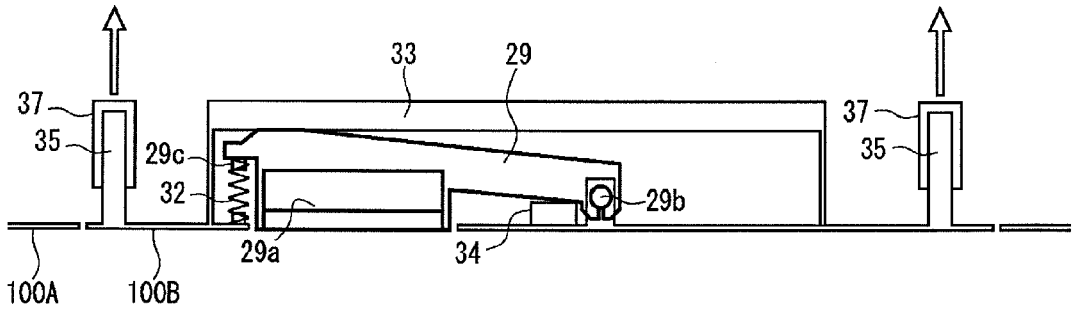
FIG. 10 is a schematic sectional view of the hand lever of the side door, and its adjacencies, and is for describing the structure of the essential portions of the hand lever.
Figure 10:
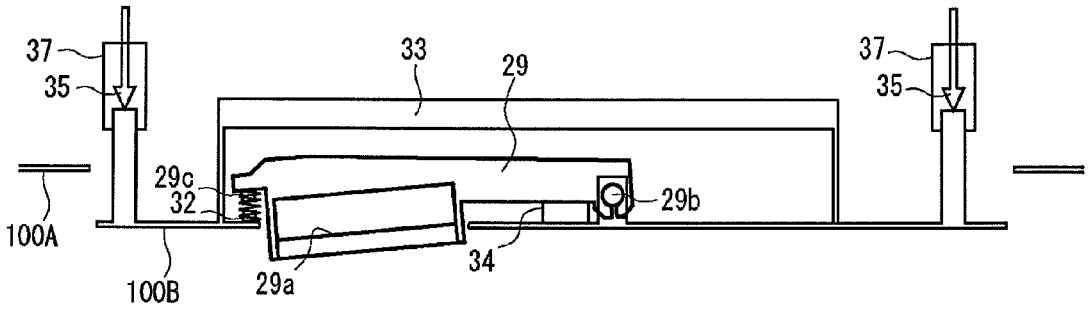
Figure 11:
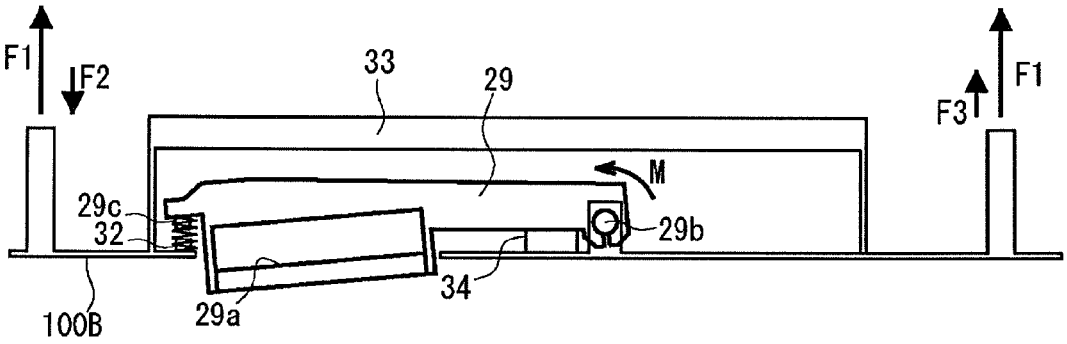
FIG. 11 is a drawing for describing the force to which the side door is subjected as the hand lever is pulled.

FIG. 8 is a drawing for describing the positioning of the hand lever 29 relative to the door unit frame 28. FIG. 9 is a perspective view of the hand lever 29. FIG. 10 is a schematic sectional view of the essential portions of the hand lever 29, which are on the inward side of the door unit 100B. FIG. 11 is a drawing for describing the force to which the door unit 100B is subjected as the hand lever 29 is pulled by a user, by the latch 29*a*.

Referring to FIG. 8, the latch 29*a* of the hand lever 29, which is to be pulled by a user when the user wants to open the door unit 100B, is positioned very close to the front end of the door unit frame 28. Thus, the user can open the door unit 100B while remaining in the same position and attitude as those in which the user was when the user confirmed the message on the display of the control panel while standing upright in front of the apparatus main assembly 100A. The latch 29*a* of the hand lever 29, which the user is to pull to operate the hand lever 29, is partially visible through an opening 28*n* of the door unit frame 28.

Next, referring to FIG. 9, it is the front end portion of the hand lever 29 that has the latch 29*a* and spring seat portion 29*c*. The rear end portion of the hand lever 29 has the hole for the hand lever 29 to be rotationally supported by the door unit frame 28.

Next, referring to FIG. 10, the hand lever 29 is rotatably supported by its rear end portion, by a hand lever supporting shaft 29*b*, which is on the rear side of the mid point between the pair of toggle latch mechanisms 37. It makes up a part of a hand lever mechanism. The hand lever 29 is kept pressed toward the recording medium conveyance guide 33 the door unit 100B by a compression spring 32, which is between the spring seats 29*c* of the front end portion of the hand lever 29.

When the door unit 100B remains closed, the front end portion of the hand lever 29 is kept in contact with a part of the recording medium conveyance guide 33, whereby the hand lever 29 is kept within the door unit 100B by the compression spring 32 in such a manner that the outward surface of the latch 29*a* of the hand lever 29 is level with the outward surface of the side plate 36 of the apparatus main assembly 100A; the door unit 100B is on the inward side of the side plate 36.

The door unit frame 28 is provided with a hand lever catch 34, which catches the force applied to the hand lever 29 by a user to open the door unit 100B. Incidentally, in the first embodiment, the roughly mid point of the door unit frame 28 means the range of the door unit frame 28, which corresponds to the range of the apparatus main assembly 100A, which falls within 50 mm from the mid point of the apparatus main assembly 100A in terms of the front-to-rear direction of the apparatus main assembly 100A. Incidentally, the overall length of the apparatus main assembly 100A in its front-to-rear direction is 470 mm.

As the latch 29*a* of the door unit 100B is pulled by a user in the direction to open the door unit 100B, the hand lever 29 rotates about the hand lever supporting shaft 29*b* of the door unit frame 28, until the hand lever 29 comes into contact with the door unit frame 28.

As the latch 29*a* is pulled, the force applied to the latch 29*a* by the user to open the door unit 100B is caught by the center portion of the door unit frame 28, because the hand lever catch 34 of the door unit frame 28 is at roughly the mid point between the pair of toggle latch mechanisms 37. Therefore, the problem that because the latch 29*a* (hand lever 29) is positioned close to the front end of the door unit frame 28, the front side of the door unit 100B separates from the apparatus main assembly 100A before the rear side of the door unit 100B separates from the apparatus main assembly 100A, does not occur. Therefore, the door unit 100B does not feel flimsy (uncomfortable) to the user when the user opens the door unit 100B.

Further, the door unit 100B in this embodiment is structured so that the hand lever 29 is rotationally movable. Therefore, the deformation of the hand lever 29 in this embodiment is more difficult for a user to recognize than the deformation of a hand lever (29) immovably attached to the door unit 100B. Therefore, the door unit 100B of the image forming apparatus 100 in this embodiment is easier to open, and also, is significantly better in terms of how the door unit 100B feels to a user when the user opens the door unit 100B.

Next, referring to FIG. 11, the hand lever catch 34 of the door unit frame 28 is at roughly the mid point of the door unit 100B in terms of the front-to-rear direction. Thus, as the door unit 100B pulled by a user by the latch 29*a* comes into contact with the hand lever catch 34, the force applied to the latch 29*a* of the hand lever 29 to open the door unit 100B begins to be directed as indicated by arrow marks.

As the door unit frame 28 and hand lever 29 are subjected to the force applied by the user to open the door unit 100B, they are deformed by the force. Therefore, as the hand lever 29 comes into contact with the hand lever catch 34 of the door unit frame 28, a moment M, which works in the direction to rotationally move the hand lever 29 about the center of the hand lever catch 34 of the door unit 100B, is generated in the joint between the hand lever 29 and the door unit frame 28, that is, the hand lever supporting shaft 29*b*.

This moment M generates forces F2 and F3 in the front (left in FIG. 11) and rear (right in FIG. 11) toggle latch mechanisms 37, respectively. The force F2 works in the direction to pull the door unit 100B away from the apparatus main assembly 100A, whereas the force F3 works in the direction to pull the door unit 100B into the apparatus main assembly 100A.

The generation of these forces destroys the balance between the front and rear toggle latch mechanisms 37 in terms of the amount of the force which keeps the door unit 100B held to the apparatus main assembly 100A, making it likely for the front end of the door unit 100B to separate from the apparatus main assembly 100A ahead of the rear end of the door unit 100B. In this embodiment, therefore, the hand lever catch 34 is positioned on the rear side of the center of the door unit frame 28 in terms of the front-to-rear direction, in order to cancel the above-described imbalance. Therefore, the door unit 100B (image forming apparatus 100) in this embodiment is significantly better, in terms of how the door unit feels when a user opens the door unit, than a door unit (100B), the hand lever catch (34) of which is at the center of the door unit frame 28.

In the first embodiment, the front and rear ends of the door unit 100B are the same in terms of the amount of a force F1 by which the hook 35 is held (pulled). Thus, the hand lever catch 34 is positioned at roughly center of the door unit 100B. This setup, however, is not mandatory. For example, even if the present invention is applied to an image forming apparatus, the front and rear ends of the door unit 100B of which are made different in the amount of the force with which they are kept pressed upon the side plate 36, in order to make the front end of the nip which the second transfer roller (16) forms, different in nip pressure from the rear end of the nip, the same effects as those described above can be obtained by positioning the hand lever catch 34 at a point where the moment generated by the front toggle latch mechanism 37 and the moment generated by the rear toggle mechanism 37 cancel each other.

Further, it is not mandatory that the hand lever 29 is rotationally movable. That is, it may be connected to the point of the door unit frame 28, at which the moment generated by the front toggle latch mechanism 37 and the moment generated by the rear toggle mechanism 37 cancel each other. As for the positioning of the toggle latch mechanisms 37, all that is necessary is that their positions corresponds to the front and rear ends of the door unit in terms of the direction parallel to the axial line of each recording medium conveyance rollers. In other words, the image forming apparatus 100 may be structured so that the hooks 35 are solidly attached to the apparatus main assembly 100A, and the toggle lever mechanisms 37 are attached to the door unit 100B.

As will be evident from the description of the image forming apparatus 100 and its door unit 100B in this embodiment, the present invention can provide a door unit for an image forming apparatus, which is significantly smaller in component count, simpler in structure, better in operability, and also, has significantly better operational feel than any of conventional door units. In other words, the present invention can provide an image forming apparatus which is significantly superior in customer satisfaction than any of conventional image forming apparatuses.

As will be evident also from the description of the image forming apparatus 100 and its door unit 100B in this embodiment, according to the structural design of the image forming apparatus in the first embodiment, the force applied to the door unit 100B is caught by the center portion of the door unit 100B. Thus, the door unit 100B does not feel as flimsy and uncomfortable as any of conventional door units. Further, it does not occur that one end of the door unit 100B separates from the apparatus main assembly 100A ahead of the other end. That is, the present invention can realize a door unit (side door unit) for an image forming apparatus, which is smaller in component count and simpler in structure than any of conventional door units.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 124705/2010 filed May 31, 2010 which is hereby incorporated by reference.

What is claimed is:

1. An image forming apparatus comprising:

a main assembly;

a door capable of opening and closing a side of said main assembly, wherein said door is rotatable about a first rotation axis extending along a widthwise direction of said door;

a rotatable member rotatably supported on said door, said rotatable member being provided with a grip portion for facilitating opening said door, wherein said rotatable member is rotatable about a second rotational axis extending in a direction crossing with the first rotation axis; and an abutment, provided on said door, for being abutted by said rotatable member when said rotatable member is rotated to open said door, wherein said grip portion is disposed in a front side of said main assembly with respect to a widthwise direction of said door, and said abutment is provided in a position closer to a center portion of said door than said grip portion.

2. An apparatus according to claim 1, further comprising a pair of feeding rollers for forming a feeding nip for feeding a recording material, and a pair of urging portions, provided in different positions with respect to the widthwise direction of the door, for urging said door in a direction of closing said door when said door is closed, wherein said door rotatably supports one of said feeding rollers, and said abutment is disposed in a central portion of a region sandwiched by said urging portions.

3. An apparatus according to claim 2, wherein said abutment is disposed in a position which is offset toward said second rotational axis side away from a center of said urging portions.

4. An apparatus according to claim 3, wherein said second rotational axis is disposed closer to a rear side of said main assembly than the center portion of said door with respect to the widthwise direction of said door, and said abutment is disposed closer to a rear side of said main assembly than a center of said urging portions.

5. An apparatus according to claim 1, wherein said abutment is disposed in a position offset toward said second rotational axis away from the center portion of said door.

6. An apparatus according to claim 5, wherein said second rotational axis is disposed in a position closer to a rear side of said main assembly than the center portion of said door, and said abutment is disposed in a position closer to a rear side of said main assembly than the center portion of said door.

7. An apparatus according to claim 1, wherein said pair of urging portions include a pair of toggle latch mechanisms.

* * * * *